US008601856B2

(12) United States Patent
Battenfeld

(10) Patent No.: US 8,601,856 B2
(45) Date of Patent: Dec. 10, 2013

(54) PLIERS HEAD WITH A LOCATOR

(75) Inventor: Kurt Battenfeld, Ebsdorfergrund/Wittelsberg (DE)

(73) Assignee: WEZAG GmbH Werkzeugfabrik, Stadtallendorf (DE)

( * ) Notice: Subject to any disclaimer, the term of this patent is extended or adjusted under 35 U.S.C. 154(b) by 0 days.

(21) Appl. No.: 13/311,975

(22) Filed: Dec. 6, 2011

(65) Prior Publication Data

US 2012/0144893 A1 Jun. 14, 2012

(30) Foreign Application Priority Data

Dec. 9, 2010 (DE) ..... 10 2010 061 148

(51) Int. Cl.
*H01R 43/042* (2006.01)

(52) U.S. Cl.
USPC ..... 72/409.14; 72/461; 29/751

(58) Field of Classification Search
USPC ..... 72/409.1, 409.01, 409.07, 409.08, 72/409.11, 409.13, 409.14, 409.16, 412, 72/416, 420, 461; 29/751; 81/300
See application file for complete search history.

(56) References Cited

U.S. PATENT DOCUMENTS

| | | | | |
|---|---|---|---|---|
| 3,457,764 | A * | 7/1969 | McKee | 72/31.07 |
| 3,673,848 | A * | 7/1972 | Filia | 72/409.14 |
| 3,710,611 | A * | 1/1973 | Filia | 72/409.06 |
| 4,754,636 | A * | 7/1988 | Kautz et al. | 72/409.14 |
| 4,982,594 | A * | 1/1991 | Wiebe | 72/416 |
| 5,212,978 | A * | 5/1993 | Liu | 72/409.14 |
| 5,236,331 | A * | 8/1993 | Liu | 72/461 |
| 5,924,322 | A * | 7/1999 | Caveney | 72/409.14 |
| 6,155,095 | A | 12/2000 | Beetz | |
| 8,161,789 | B2 * | 4/2012 | Battenfeld et al. | 72/409.14 |
| 2009/0217791 | A1 | 9/2009 | Battenfeld et al. | |
| 2009/0249855 | A1 | 10/2009 | Battenfeld et al. | |

FOREIGN PATENT DOCUMENTS

| | | | |
|---|---|---|---|
| DE | 27 18 165 | A1 | 10/1978 |
| DE | 94 00 937 | U1 | 4/1994 |
| DE | 29 812 631 | U1 | 1/1999 |
| DE | 198 32 884 | C1 | 12/1999 |
| DE | 20 2006 012 869 | U1 | 1/2008 |
| DE | 10 2008 017 366 | A1 | 10/2009 |
| DE | 10 2008 012 011 | B3 | 12/2009 |
| DE | 20 2010 008 988 | U1 | 4/2012 |
| EP | 2 182 595 | A2 | 5/2010 |
| JP | 51-133778 | U | 4/1975 |
| JP | 2010-009 768 | A | 6/2008 |
| WO | 2012/062 538 | A1 | 5/2012 |

OTHER PUBLICATIONS

German Office Action in co-pending, related Application No. DE 10 2010 061 148.4, mailed Jul. 29, 2013.

* cited by examiner

*Primary Examiner* — David B Jones
(74) *Attorney, Agent, or Firm* — Thomas | Horstemeyer, LLP

(57) ABSTRACT

The present invention relates to a pliers head for crimping pliers. The pliers head comprises at least two dies for crimping a connector. A locator comprises at least one nest. The nest is configured and designed for housing the connector. According to the invention, the nest has a width which is at least as large as the distance between a first die and an adjacent second die of the pliers head. The locator has two crimping states: In a first crimping state, the nest is located at a predetermined position aligned with the first die. In the second crimping state, the nest or another nest of the locator is located at a predetermined position aligned with the second die.

7 Claims, 7 Drawing Sheets

PLIERS HEAD WITH A LOCATOR

CROSS REFERENCE TO RELATED APPLICATIONS

This application claims priority to co-pending German Patent Application No. DE 10 2010 061 148.4 entitled "Zangenkopf für eine Presszange", filed Dec. 9, 2010.

FIELD OF THE INVENTION

The present invention generally relates to a head of crimping pliers used for crimping a work piece as a connector, in particular for the connection of an end of an electrical cable or line with the connector. The present invention covers any embodiment wherein the crimping is done by manual actuation, hydraulic actuation, actuation by an electrical aggregate or any other type of actuation.

BACKGROUND OF THE INVENTION

Heads of crimping pliers of the present type are used for crimping pliers for crimping a contact or connector (in the following "connector") with an end of a line, cable or wire with at least partially removed insulation. During the crimping process the connector is plastically deformed and pressed against the cable end which is located within the connector. Due to the removed insolation an electrical contact is established under the plastic deformation. On the other hand, the crimping process provides a durable connection between the connector and the cable end.

It is also known to equip crimping pliers with a locator. Locators are used for positioning the connector relative to a base body of the head of the crimping pliers, in particular for defining the predetermined position of the connector with respect to the cable end and/or for a coaxial alignment of the connector with the cable end. The locator guarantees that at the beginning of the crimping process the connector and the cable end have the desired position with respect to a die of the head of the crimping pliers. It is also possible that the crimping process and during the plastic deformation of the connector the locator during provides or withholds the predetermined relative position and orientation of the connector and of the cable end with respect to the die.

A plurality of constructions of crimping pliers, heads of crimping pliers, locators and configurations for moving degrees of freedom for the locator are known from the prior art:

Crimping pliers known from DE 27 18 165 A1 comprise a head with a C-shaped frame which is laterally open. For another embodiment of DE 27 18 165 A1, crimping jaws and die halves mounted with the crimping jaws move towards each other similar to scissors. For both embodiments, the head of the crimping pliers defines a head plane wherein the tool parts building the die halves and crimping jaws move during the crimping process. The crimping pliers comprise a locator which is pivotable around a pivoting axis between a loading state for inserting the connector and a crimping state. The pivoting axis has an orientation perpendicular to the afore mentioned head plane. Accordingly, it is possible to pivot the locator into the loading state for inserting or assembling the connector, to insert the connector into the nest of the locator and pivot the locator with the connector housed in the nest back to the crimping state, wherein the connector is held with a predetermined relative position and orientation with respect to the tool parts and in a position aligned with the die. Subsequently, the connector is plastically deformed during the crimping process actuated by actuation of the crimping pliers, here by means of two manually pivoted hand levers.

The applicant of the present invention also distributes crimping pliers under the trademark "CS20KS". These crimping pliers comprise also a C-shaped head which is laterally open. At the head of the crimping pliers a locator is linearly guided along an axis having an orientation parallel to the horizontal leg of the C and located parallel to the head plane. The locator is driven by a pivotable lever supported at the head of the pliers. The pivoting movement of the lever is transferred by a pin guided in an elongated hole into a linear movement along the axis for the linear movement of the locator.

The applicant of the present invention also distributes crimping pliers under the trademark "CS25KS". Also these crimping pliers have a C-shaped head. Here, a locator is pivoted around a pivoting axis with respect to the main body or frame of the pliers head. For this embodiment the pivoting axis has an orientation perpendicular to the head plane. By means of a manual actuation of a knurled button the locator is pivoted between a crimping state and a loading state.

DE 198 32 884 C1 (see U.S. Pat. No. 6,155,095) discloses crimping pliers with a head built by sandwiched plates. Here, the head is not C-shaped with a transverse opening but O-shaped with a central opening. Upon manual actuation of the hand levers, a movable tool part is displaced along a longitudinal axis relative to a tool part fixed at the head of the crimping pliers. The patent discloses a locator which is pivoted around a pivoting axis. The pivoting axis has an orientation parallel to the head plane as well as transverse to the moving direction of the tool parts of the crimping pliers. In the crimping state the locator has an orientation parallel to the head plane. From this crimping state, the locator is pivoted around the pivoting axis out of the head plane into the loading state.

For the above locators the required movement of the locator between the loading state and the crimping state requires that one hand of the user grips the handles of the crimping pliers whereas the other hand of the user moves the locator between the crimping state and the loading state. In contrast to these embodiments, DE 10 2008 017 366 A1 (see US 2009/0249855A1) discloses a locator with respect to a base body of the pliers head. The locator has an extension extending into the close neighborhood of the hand levers. It is possible to pivot the locator with the thumb of the hand gripping the handles of the crimping pliers. Accordingly, the use of the crimping pliers, in particular a one-hand use of the crimping pliers and the locator, is eased.

DE 10 2008 012 011 B3 (see US 2009/0217791 A1) discloses a pliers head with a plurality of die halves held or built by tool parts wherein the tool parts are moved towards each other during the crimping process. Here, the die halves have a translational degree of freedom transverse to the head of the crimping pliers such that for different work pieces different die halves can be located in a central position of the pliers head. Accordingly, it is possible to use different crimping die halves with optimized force conditions for different work pieces. On the other hand, it is possible to increase the number of different crimping die halves with different contours and geometries built by a die matrix.

SUMMARY OF THE INVENTION

It is an object of the invention to provide a pliers head having a locator which is improved with respect to the required design envelope, the number of crimping die halves at a die matrix and/or the possible cross-sectional dimensions of a connector which is to be crimped by the head of the crimping pliers.

Before the priority date of the present invention it has been known to provide more than one nest for a connector at one and the same locator. Here, each nest was aligned with an associated die formed by a die matrix one. However, the skilled persons relied upon the prejudice that necessarily any crimping die halve of the die matrix should have a distance from an adjacent die halve that is larger than the width of the connector also in the cross-sectional region which is held by the locator. This prejudice was based upon the finding that when violating this implicit rule adjacent connectors could not be nested in the locator one besides another.

The present invention for the first time overcomes this prejudice which leads to improved option for the design envelope, the option of using larger connectors and/or the use of an increased number of crimping die halves at a crimping die matrix of the pliers head:

The invention suggests equipping the locator with a first nest. The width of the first nest (and optionally also of possible other nests) is at least as large as the distance between a first die and an adjacent second die of the pliers head. The locator comprises (besides the loading state) a first crimping state as well as a second crimping state. In the first crimping state of the locator, the first nest is located in a predetermined position and/or orientation aligned with the first die. Accordingly, in the first crimping state it is possible to crimp a connector with a cable end in the first die. Due to the afore mentioned dimensions of the width of the first nest, it is also possible to crimp a connector which is larger than connectors crimped by the prior art pliers heads without necessarily increased dimensions of the pliers head. It is also possible that for the same connectors the first die might have a distance from an adjacent second die which is reduced to the respective distances known from the prior art. According to the invention it is also possible that (due to the large width of the connector and the related first nest) an outer region of the first nest in the first crimping state extends into an area aligned with the second die. In the second crimping state and for a use of the second die for crimping a different connector an outer region of a second nest might now extend into this area.

For the design and configuration of the second crimping state of the locator according to the present invention, there are in particular two options:

a) It is possible that also in the second crimping state of the locator the first nest of the locator is usable. For this embodiment, in the second crimping state the first nest of the locator is in a predetermined position and/or orientation aligned with the second die. Accordingly, it is possible to use one and the same nest of the locator with different dies. In the two differing crimping states the same or different connectors and/or cable ends might be crimped. By use of the nest with the two dies in different crimping states, the above described prejudice with respect to the dimensions of the width of the nest and so the width of the connector in relation with the distance of the two dies is overcome.

b) According to a different embodiment, in the second crimping state a second nest of the locator is brought into a predetermined position and/or orientation aligned with the second die. In case that both the first and the second nest would at the same time be located aligned with the first and second die (without the inventive movement for a change of the crimping state), the two connectors would collide or "overlap" in the adjacent nests of the locator such that the two nests would have to be built with a kind a of "overlap". The collision is avoided according to the invention by crimping a connector located in the first nest of the locator in the first die in the first crimping state. During this crimping process it is possible that no nest is located aligned with the second die such that this area is free and a part of the first nest might extend into this area. With the transfer from the first to the second crimping state the region aligned with the first die is freed from the first nest such that a second nest being located aligned with the second die might at least partially extend into this freed region.

It is possible that in the first crimping state and the second crimping state (as well as any possible additional intermediate state) the position is multi-stable. For one example, an active crimping state is withheld by friction. When applying transfer forces for changing the crimping state, these forces have to overcome the friction, wherein it might be possible to change the crimping state in a stepless manner. For another embodiment of the invention, the locator is latched, rested or locked in the first and/or second operating state.

A latching mechanism is any mechanism or device that keeps the locator in an crimping state for small acting transfer forces, whereas it is possible to move the locator away from the latched crimping state for larger transfer forces. One example for a latching mechanism is built with a spring loaded latching element, in particular a latching sphere. The latching element or sphere engages a latching opening or groove. The geometry of the latching element, the diameter of the latching sphere, the contour of the latching groove and the stiffness of the spring supporting the latching element influence the amount of transfer force which is required for removing the locator from a latched crimping state. Another embodiment of a latching mechanism is built with a magnet, wherein the force of the magnet determines the transfer force required for leaving a latched crimping state. By means of the latching mechanism, it is also possible to give a haptic feedback to the user during the transfer of the locator from or into a crimping state.

In a locking mechanism I is not possible to leave a locked state only under the application of a transfer force. Instead, it is required to remove the locking connection of a locking element, in particular a locking bolt, a locking pawl or any differing locking element with a counterelement. The locking element or counterelement has to be released by a hand of a user or by an additional actuating means for releasing the positive lock.

The locking or latching mechanism guarantees that the locator is in a predetermined position or crimping state which in the end increases the precision of the crimping process. Furthermore, it is possible that the latching or locking mechanism avoids that during the crimping process with large acting crimping forces the locator changes the crimping state.

A movement of the locator between the first and second crimping state (and any additional crimping state) might be any movement, in particular a translational or pivoting movement. The movement might be provided by suitable links with other components of the pliers head, suitable guiding element or bearings. Furthermore, it is possible that an actuating mechanism for the movement between the first and second crimping state is provided, e.g. with levers, transmissions, buttons, knurled wheels and the like.

For a specific embodiment of the invention the locator is moved along a translational degree of freedom between the first and the second crimping state. It is possible that during this translational movement the parts of the locator are guided by a guiding unit, e.g. a guiding rail, a tongue-groove-connection and the like, wherein the guiding unit might also be equipped with the latching or locking mechanism, stop elements or otherwise secured positions.

For one embodiment of the invention, the translational degree of freedom of the locator extends parallel to the connecting straight line between the first die and the adjacent second die. Accordingly, it is possible to transfer a nest of the locator from a crimping state aligned with the first die to a crimping state aligned with the adjacent second die by use of the translational degree of freedom. For a specific embodiment, the locator might solely comprise one single nest which might be used with different dies in the different crimping states.

For an alternative embodiment of the invention, the locator is pivoted between the first and second crimping state. The pivoting degree of freedom of the locator might be provided by any linking or bearing mechanism. In order to name a non-limiting example, the locator might be built by a pivot joint built by a bearing bolt extending through a bearing sleeve or bearing lug.

It is possible that the locator is only pivoted by an angle of less than 360°. Another embodiment of the invention suggests building the locator with a type of revolver or rotating disc (in the following "revolver"). Here, it is also possible that the revolver is not pivoted in forward and backward direction. Instead, it is also possible to pivot the locator in the different crimping states by a pivoting or rotating movement in one single direction with an angle of rotation of more than 360°.

It is also possible that a nest of the revolver is used in cooperation with a plurality of dies in the different crimping states. However, for another embodiment of the invention in the first crimping state of the revolver a first nest is located aligned with a first die. In the second crimping state of the revolver a second nest is located aligned with the second die.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
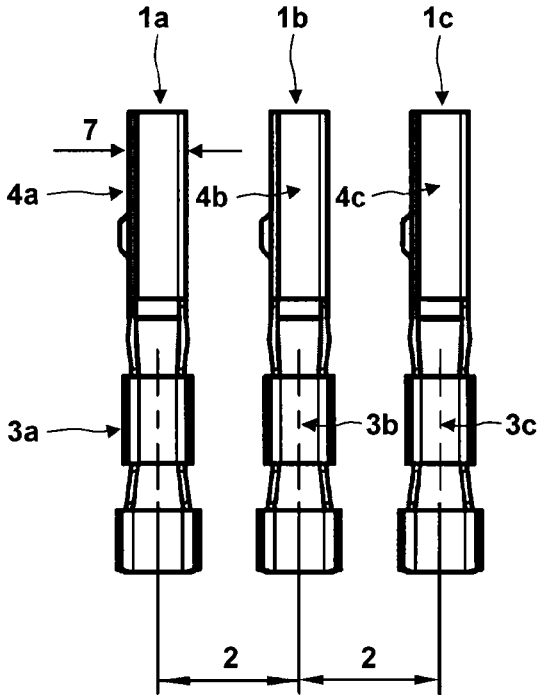
FIG. 1 shows three connectors having a comparatively small width.

FIG. 1 shows three connectors 1*a*, 1*b* and 1*c*. The longitudinal axes have an orientation parallel to each other. The distance 2 between the connectors 1*a*, 1*b* and 1*c* is chosen such that the distance 2 of the connectors 1*a*, 1*b* and 1*c* equals the distance of crimping die halves 25*a*, 25*b*, 25*c* and 25*d* as well as 26*a*, 26*b*, 26*c* and 26*d* built by crimping die matrices 23, 24 of a crimping pliers head 18 (see FIG. 4). The connectors 1 each comprise a crimping region 3. Before the crimping process, the cable end with removed insolation is inserted into the crimping region 3. Then, during the crimping process the crimping region 3 is crimped in a die 37*a* (37*b*; 37*c*; 37*d*), wherein the crimping die 37*a* (37*b*; 37*c*; 37*d*) is built by a pair of crimping die halves 25*a*, 26*a* (25*b*, 26*b*; 25*c*, 26*c*; 25*d*, 26*d*).

Figure 2:
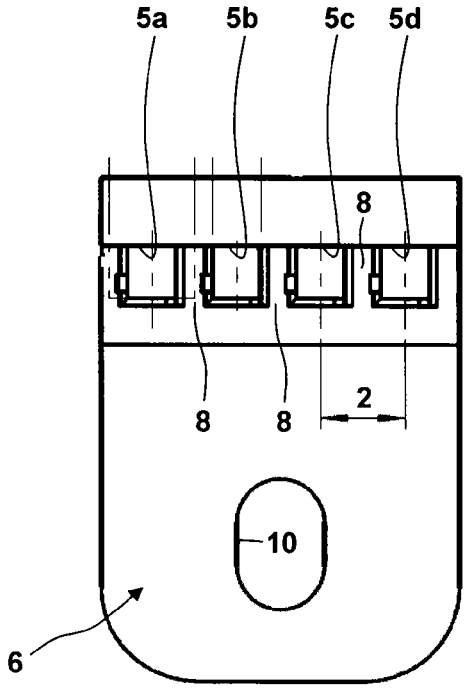
Fig. 2 (Prior Art)
FIG. 2 shows a locator according to the prior art for crimping the connectors according to FIG. 1 in adjacent crimping die halves of die matrices of a crimping pliers head.

The connectors 1 each comprise a connector region 4, which is located in a nest 5 of a locator 6 (see FIG. 2). The connector region 4 is not deformed during the crimping process. The connector region 4 is used for positioning and orienting the connector 1 before and during the crimping process. As can be seen from FIG. 1, the width 7 of the connector 1, here the extension transverse to the crimping direction, is smaller than a distance 2 of adjacent crimping die halves 25, 26 in the same direction. Accordingly, it is possible to position connectors 1 optionally in the different nests 5*a*, 5*b*, 5*c*, 5*d* wherein the nests have a fixed distance from each other. The adjacent nests 5 of the locator 6 are separated by a bridging material or link 8. There is no need for a movement of the locator from a first crimping state to a second crimping state.

With an increase of the width 7 of the connectors and the nests, the wall thickness of the link or bridging material 8 reduces. In case that a minimum wall thickness of the bridging material or link 8 is required, a further increase of the width 7 requires an increase of the overall width of the locator 6 according to FIG. 2. This increase leads to an increase of the width of the die matrices 23, 24 and the whole pliers head 18.

Figure 3:
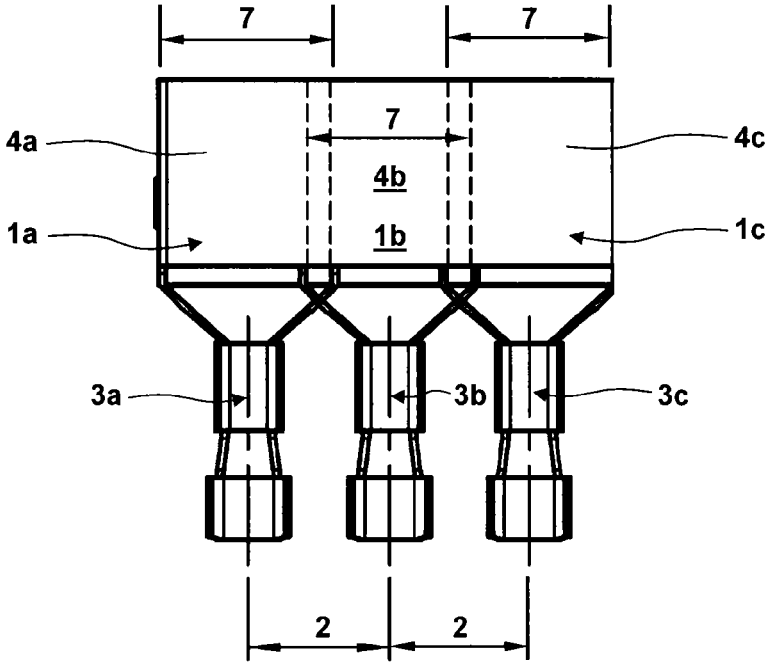
FIG. 3 shows connectors with a larger width intended for being crimped with an inventive crimping pliers head with a locator.

For an explanation of the object of the invention, FIG. 3 shows connectors 1*a*, 1*b*, 1*c* with an increased width 7 of the connector regions 7. Here, the distance 2 of adjacent connectors 1 which depends on the distance of the crimping die halves 25, 26 in the crimping pliers head 18 has not been changed. FIG. 3 shows a collision of adjacent connectors 1*a*, 1*b*, 1*c* with the consequence that the bridging material or link 8 is completely removed and it is not possible to place adjacent connectors 1 at the same time into the respective adjacent nests 5.

Figure 4:
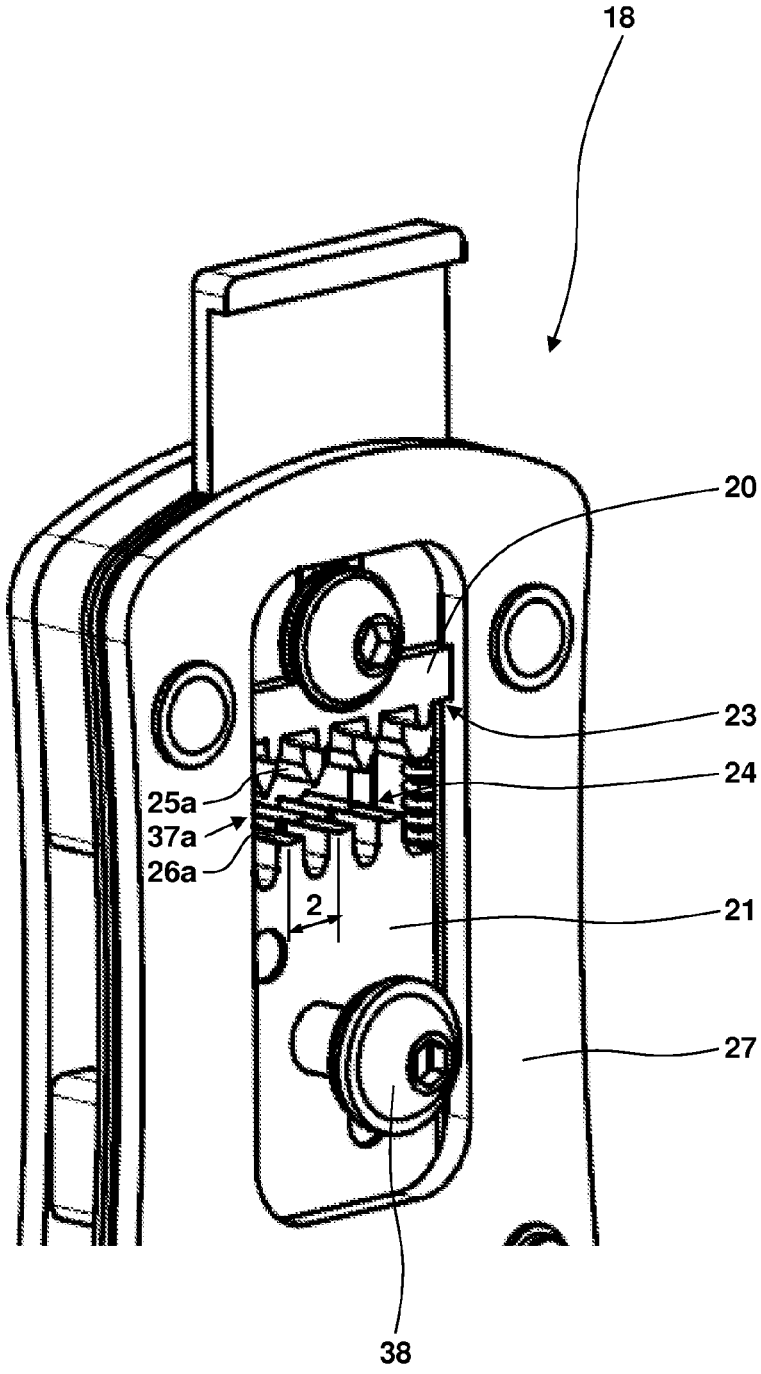
FIG. 4 shows a pliers head without a locator according to the prior art in a three-dimensional view.

FIG. 4 shows a pliers head according to the prior art without a locator. With an actuation, here by manual pivoting actuation of the hand levers 35, 36, crimping jaws or two tool parts 20, 21 are moved towards each other in vertical direction in FIG. 4. The tool parts 20, 21 each carry respective crimping die matrices 23, 24 or integrally build the same. For the shown embodiment, the tool part 20 is fixed with the housing or frame of the head 18, whereas tool part 21 is moved vertically in upward direction with a pivoting movement of the hand levers 35, 36. During this movement, tool part 21 is guided by frame 27. For the shown embodiment, the crimping die matrices 23, 24 are each built with four crimping die halves 25*a-d* and 26*a-d*. The crimping die halves each have a distance 2 from adjacent crimping die halves measured transverse to the crimping direction. Pairs of crimping die halves 25*a*, 26*a* (25*b*, 26*b*; 25*c*, 26*c*; 25*d*, 26*d*) together build dies 37*a*, 37*b*, 37*c*, 37*d*. With a closing movement of the tool parts 20, 21 the crimping die halves 25, 26 close in circumferential direction. The different crimping die halves 25, 26 of the crimping die matrices 23, 24 might have the same or differing geometries and contours such that they might be designated for the same or different connectors. In the closed state, the two tool parts 20, 21 are pressed against each other. For the shown embodiment, a screw or bolt 38 is fixed at the tool part 21. The screw 38 extends vertical to the head plane and is used for fixing an inventive locator 6.

Figure 5:
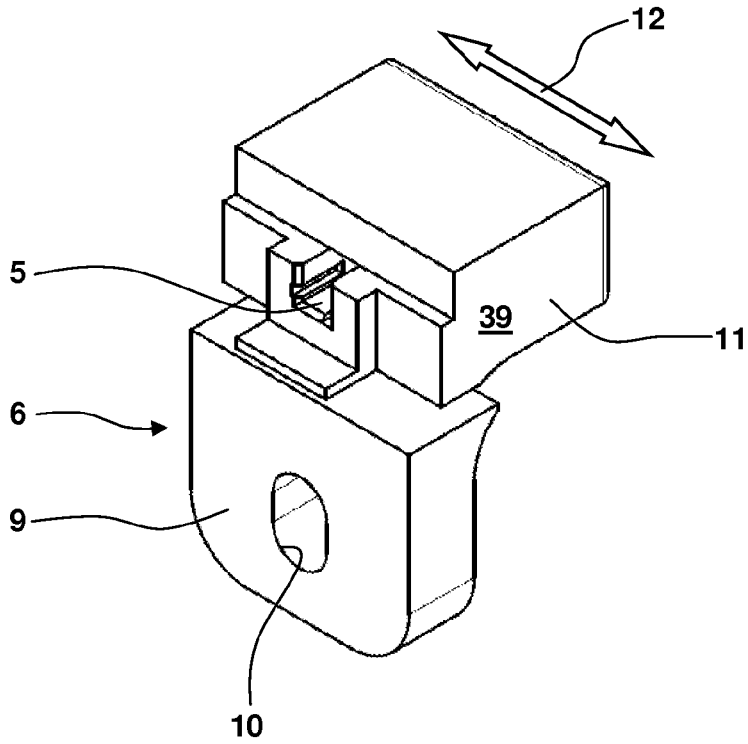
FIG. 5 shows the inventive locator in a three-dimensional view, wherein one and the same nest is movable along a translational degree of freedom from a first crimping state into a second crimping state.

FIG. 5 shows an inventive locator 6. The locator 6 comprises a holding body 9 which is fixedly or releasably, locked, rested or latched with another component of the crimping pliers head 18. The holding body 9 shown in FIG. 5 comprises a bore or elongated hole 10. A screw 38 mounted with tool part 20, 21 or with the frame 27 of the crimping pliers head 18 or another element extends through the bore or elongated hole 10. The locator 6 according to FIG. 5 comprises a movable body 11 which is movable along a translational degree of freedom 12 with respect to the holding body 9. The translational degree of freedom 12 has an orientation parallel to the connecting line between adjacent crimping die halves 25 *a-d*, 26*a-d* or dies 37*a-d* of the crimping pliers head 18. On the side facing towards the crimping dies 37, the movable body 11 builds a first (and only) nest 5. The cross-section of the nest 5 is adapted to the cross-section of the connector region 4. The depth of the nest 5 has a dimension such that it is possible to locate the crimping region 3 in the respective die 37. The movable body 11 comprises side surfaces 39 that might be gripped by two fingers of the user for causing a movement of the movable body 11 along the translational degree of freedom 12. The movable body 11 and the holding body 9 are connected by a suitable guiding unit, e.g. a groove-tongue-guiding unit.

Figure 6:
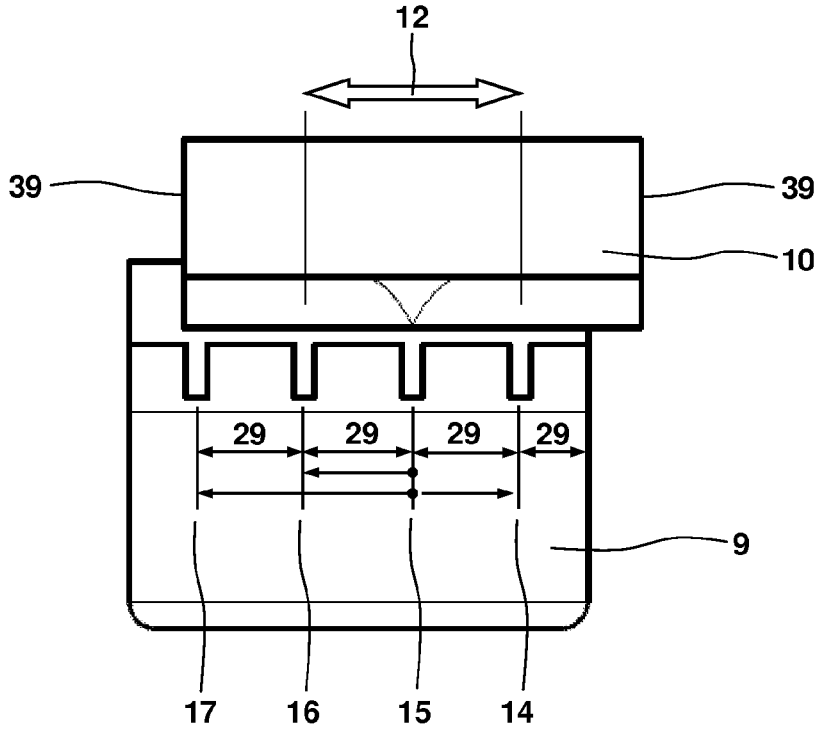
FIG. 6 shows the locator according to FIG. 5 in a front view.

FIG. 6 shows that the locator 6 comprises a first crimping state 14, a second crimping state 15, a third crimping state 16 as well as a fourth crimping state 17. The crimping states 14-17 are located one besides another in a direction transverse to the crimping direction with a distance 29. The distance 29 is chosen as large as or smaller than the width of the nest 5. In FIGS. 5 and 6 the locator is in the second crimping state 15. A change or transfer from one crimping state into another crimping state requires a movement of the movable body 11 along the translational degree of freedom 12. For one embodiment of the invention, the movable body 11 is latched or locked in all of the crimping states 14-17.

Figure 7:
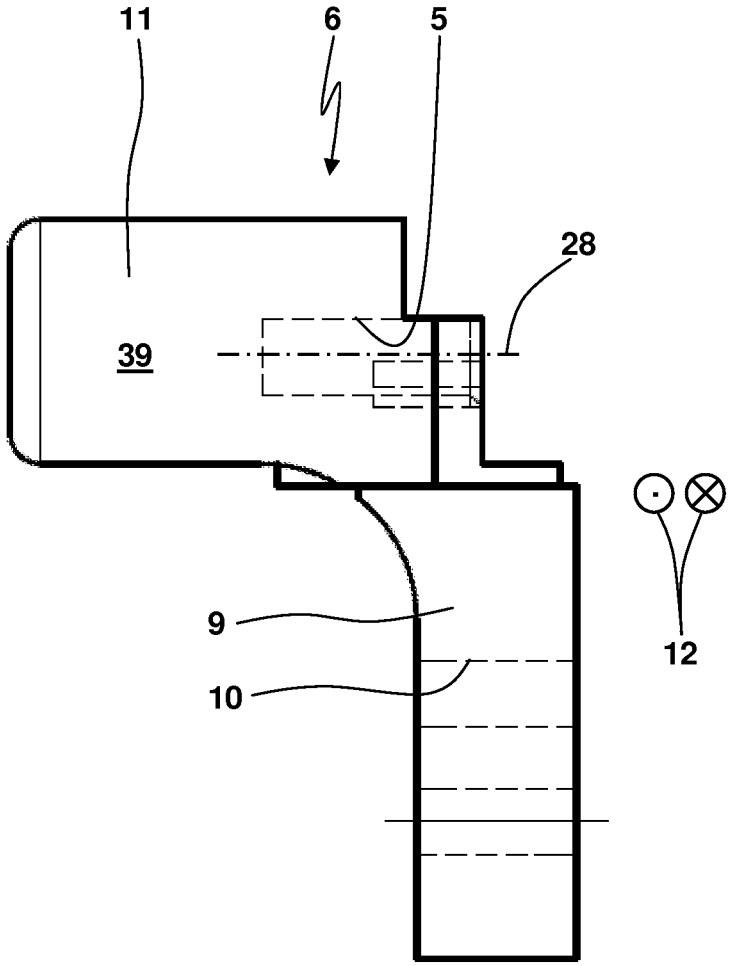
FIG. 7 shows the locator according to FIGS. 5 and 6 in a side view.
Figure 8:
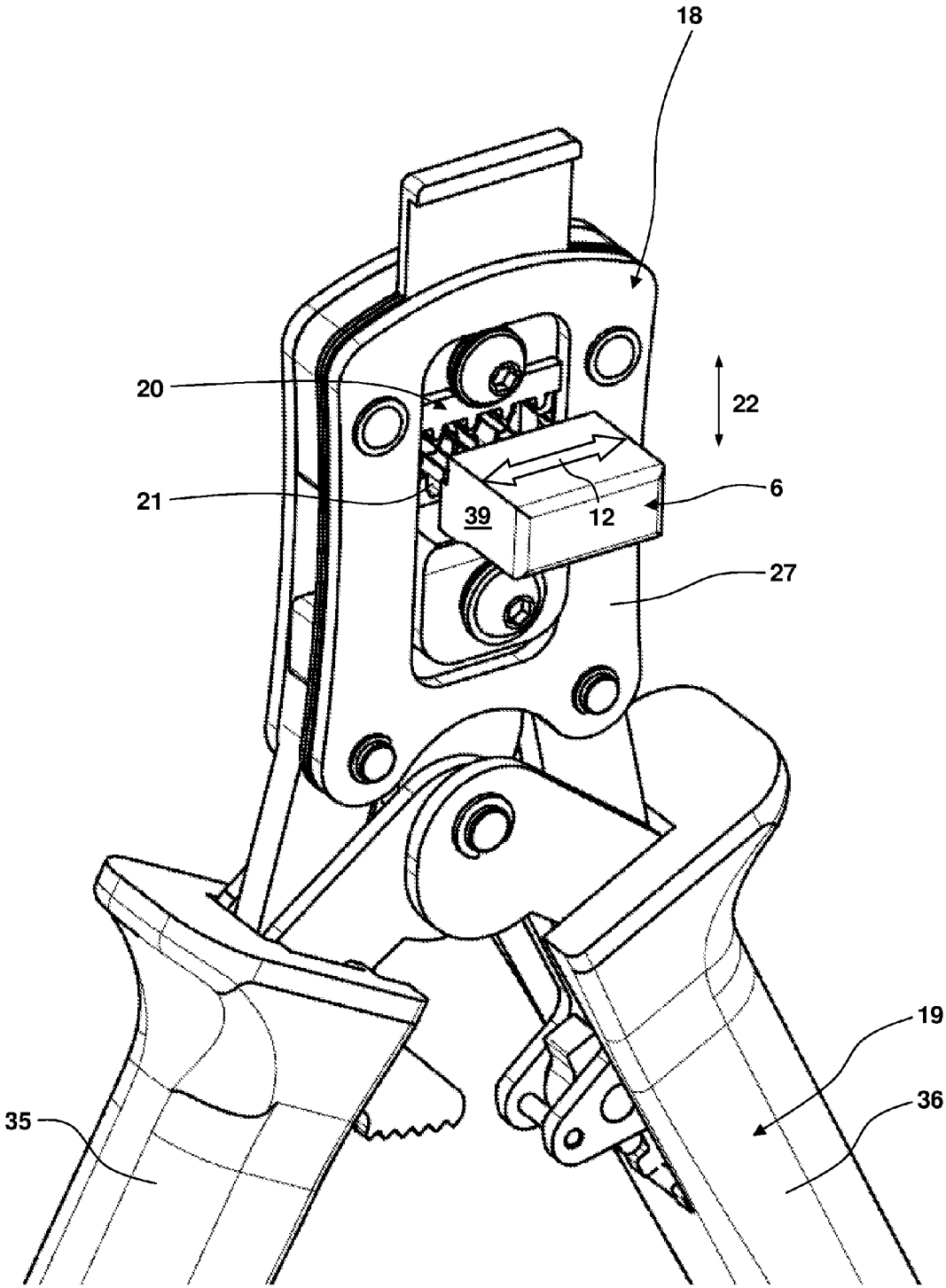
FIG. 8 shows crimping pliers with an inventive crimping pliers head comprising a locator according to FIGS. 5 to 7 in a three-dimensional view.

FIG. 8 shows the use of a locator 6 according to FIGS. 5 to 7 with a pliers head 18. The locator is (directly or indirectly) fixed at a frame 27, a fixed tool part 20 or a tool part 21 moved during the crimping process relative to the fixed tool part 20. For the embodiment shown in FIG. 8, this fixation is done by a screw 38 extending through the elongated hole 10 of the holding body 9. A head of the screw 38 abuts the outer surface of the holding body 9. The end region of the screw 38 with the thread is screwed into the relevant component of the pliers head 18, here with the tool part 21.

In the crimping states 14-17 a longitudinal axis 28 of nest 5 is located coaxially and aligned with the respective die 37*a-d*. For a movement of the locator 6 into another crimping state, the longitudinal axis 28 of the nest 5 is moved into another position, namely to another die 37*a-d*. In particular, the distances 29 between adjacent crimping states 14-17 are smaller than the width of the connector 1 in the connector regions 4 or are smaller than the width of the nest 5.

The locator 6 might be an optional additional part that due to the requirements might be optionally used together with the pliers head 18. For alternative embodiments, the locator 6 might additionally to the translational degree of freedom 12 have a pivoting degree of freedom for pivoting the locator between a loading state and the crimping states, see in particular DE 10 2008 017 366 A1 and the prior art summarized in this patent application.

For the embodiment shown in FIG. 8, a special type of crimping pliers is shown. Here, the crimping pliers have an O-shaped frame 27 and a specific actuating mechanism. A tool part is actuated manually via hand levers 35, 36 with a pivoting joint between the hand levers 35, 36, two outer pulling rods and a central pressure lever. The person with skill in the art will understand that the present invention might be used with any other different type of crimping pliers, different actuating kinematics or transmissions, different types of frames and/or differing kinematics for the tool parts during the crimping process. Furthermore, it is possible that at the pliers head different inserts of die matrices might be optionally used for increasing the number of usable crimping die geometries. Furthermore, the present invention is also usable in connection with crimping die halves being guided along a translational degree of freedom as disclosed in DE 10 2008 012 011 B3.

Figure 9:
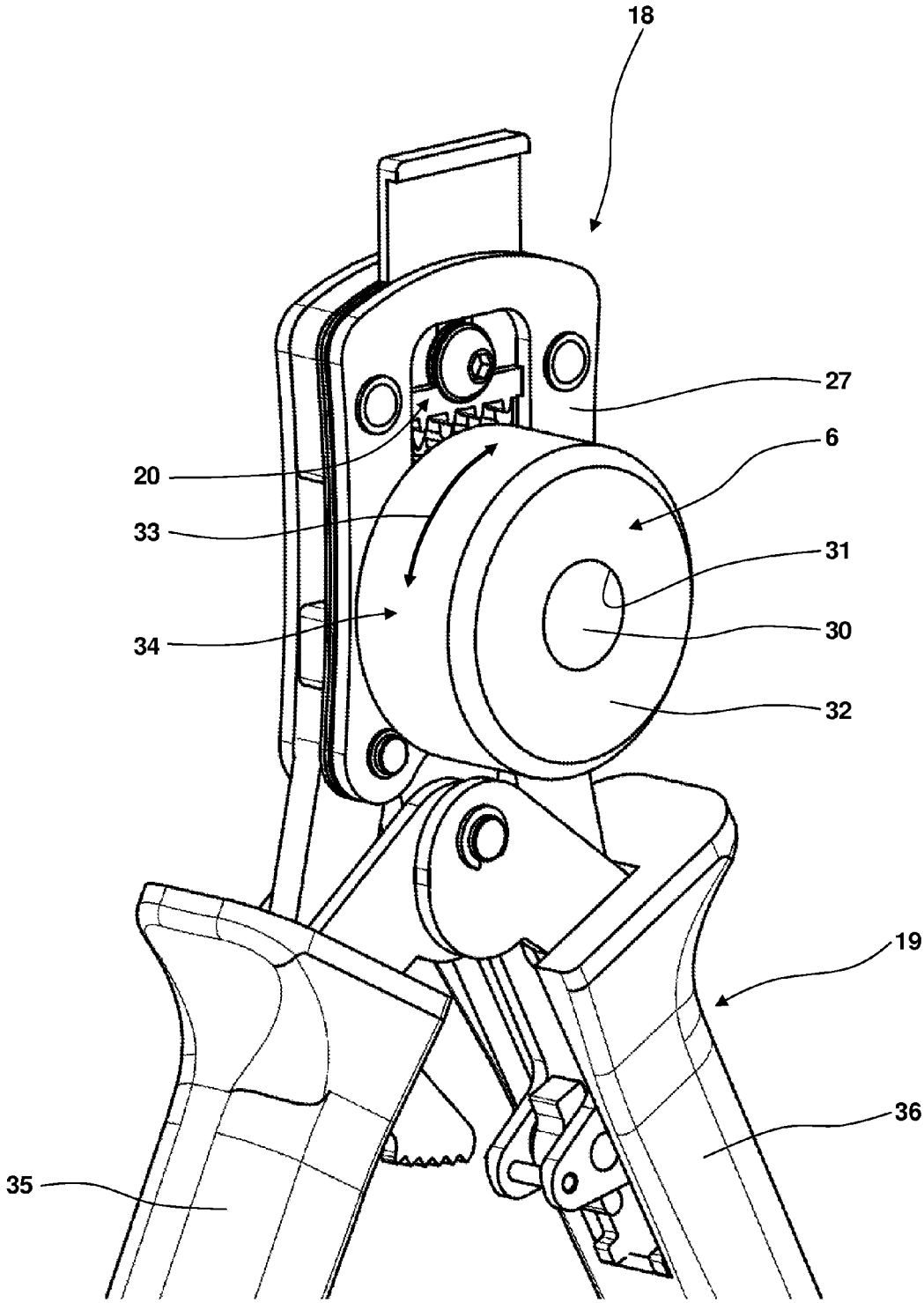
FIG. 9 shows a three-dimensional view of crimping pliers with an alternative embodiment of an inventive pliers head having a revolver-like locator.

FIG. 9 shows an alternative embodiment of a locator 6 of an inventive pliers head 18 of crimping pliers 19. Also for this embodiment the locator 6 is directly or indirectly held by a frame 27 or a tool part 20, 21 of the pliers head 18. For the fixation a bearing bolt 30 is used which extends perpendicular to the head plane. The bearing bolt 30 extends through a bore 31 of a pivoting body 32 of the locator 6. Accordingly, the pivoting body 32 has a rotational degree of freedom 33 with respect to the pliers head 18. On the side facing towards the dies 37 the pivoting body 32 comprises two sets of nests 5*a*-5*d*, 5*e-h*.

Figure 10:
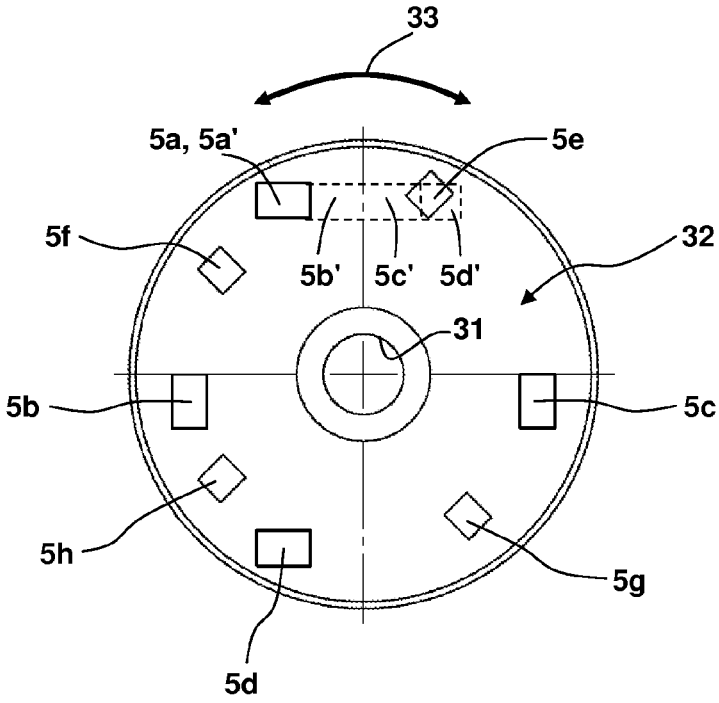
FIG. 10 shows the locator used with the inventive crimping pliers head according to FIG. 9 in a single-part drawing in a front view.

For the crimping state effective in FIG. 10 the nest 5*a* is in the crimping state 5*a*'. In this crimping state 5' the nest 5*a* is located coaxially aligned to the respective die 37*a*. Due to the fact that according to FIG. 10 a plurality of dies 37*a-d* are located one besides another when seen in horizontal direction, the use of the dies 37*a-d* requires that the dies 5*b*-5*d* (as well as the dies 5*f*-5*h*) have to be displaced for a predetermined distance from the crimping state 5*a*' of the nest 5*a* in FIG. 10. These differing crimping states are denoted with 5*b*', 5*c*' and 5*d*' in FIG. 10. In these crimping states 5*b*', 5*c*' and 5*d*' the respective nests are located aligned with the respective dies 37*b*. 37*c*, 37*d*. The same applies for the nests 5*f*-5*h*. When rotating the rotating body 32 from the first crimping state in FIG. 10 by 90° in clockwise direction, nest 5*b* is brought into the position 5*b*'. In the position 5*b*' the nest 5*b* is in the second crimping state wherein the nest 5*b* is located aligned with and coaxial to the die 37*b*. Similar a rotation of the rotating body 32 by 180° in clockwise direction from the crimping state shown in FIG. 10, the nest 5*d* is moved into the state marked with 5*d*', wherein the nest 5*d* is located aligned with and coaxial to the die 37*d*. The nest 5*c* might be brought into the state denoted with 5*c*' by a rotation of the rotating body 32 with an angle of rotation of 270° in clockwise direction, such that the nest 5*c* is located aligned with and coaxial to the die 37*c*. The corresponding applies for the nests 5*e*-5*h*. FIG. 10 shows that there is no limitation with respect to the width of the nests 5, so also no limitation for the width of the connector regions 4 of the connectors 1. Instead, the width might be increased such that in the different states 5*a*', 5*b*', 5*c*' and 5*d*' there is an "overlap" of the nests 5.

For the embodiment shown in FIG. 10, the die matrices 23, 24 each comprise four crimping die halves 25*a-d*, 26*a-d*. In the rotating body 32 two different sets are located each comprising four nests 5*a*-5*d* as well as 5*e*-5*h*. The different sets are each designated for different geometries or contours of the connector regions 4. The number of nests 5 in any such set and/or the number of sets of a rotating body 32 might be varied. It is also possible that a plurality of rotating bodies 32 is removably or optionally used in a pliers head 18. The rotating body 32 builds a type of revolver 34. The locator is in particular moved independent on the movement of the hand levers 35, 36 and the tool parts 20, 21.

Figure 11:
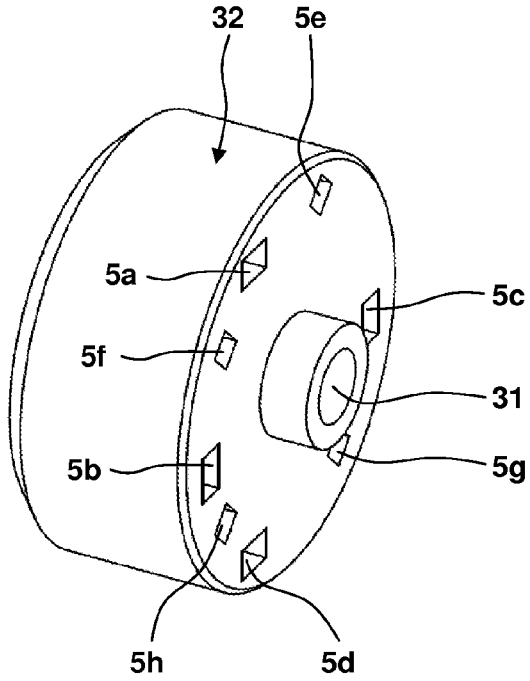
FIG. 11 shows the locator according to FIG. 10 in a three-dimensional view.

For the embodiment shown in FIG. 9-11 the nests 5*a*-5*d* of one set are not located one besides another with a distance that corresponds to the distance of the respective dies 37. Instead, the distance of the nests 5*a*-5*d* is increased with the result that the nests 5*a*-5*d* are only usable with a change of the crimping state by a rotation of the rotating body 32 along the degree of freedom 33.

Many variations and modifications may be made to the preferred embodiments of the invention without departing substantially from the spirit and principles of the invention. All such modifications and variations are intended to be included herein within the scope of the present invention, as defined by the following claims.

I claim:

1. Pliers head for crimping pliers comprising a) a first die and an adjacent second dies for crimping connectors, and b) a locator, said locator having at least one nest configured and designed for housing the connector, said nest having a width being at least as large as the distance between said first die and said second die, c) said locator having a first crimping state, wherein said nest is located at a predetermined position wherein said nest is aligned with said first die, and d) said locator is movable along a translational degree of freedom having an orientation parallel to a connecting line between an adjacent set of crimping die halves or dies of a crimping pliers head, a second crimping state differing from said first crimping state, wherein in the second crimping state ea) said nest of said locator or eb) a second nest of said locator is located at a predetermined position wherein said nest or said second nest is aligned with said second die.

2. Pliers head of claim 1, wherein a) the locator is movable between a loading state and the crimping states and b) the degree of freedom for a movement between said crimping states differs from the degree for a movement between the loading state and the crimping states.

3. Pliers head of claim 1, wherein a latching mechanism or a locking mechanism is provided for latching or locking said locator in said first crimping state and/or said second crimping state.

4. Pliers head of claim 1, wherein said locator is movably guided between said first crimping state and said second crimping state along a translational degree of freedom.

5. Pliers head of claim 4, wherein said nest of said locator is linked with a base body of said pliers head such that said nest in said first crimping state is aligned with said first die and in said second crimping state is aligned with said second die.

6. Pliers head of claim 4, wherein the path of said locator between said first crimping state and said second crimping state is larger than the distance between said first die and said second die.

7. Pliers head for crimping pliers comprising a) a first die and an adjacent second dies for crimping connectors, and b) a locator, said locator having at least one nest configured and designed for housing the connector, said nest having a width being at least as large as the distance between said first die and said second die, c) said locator having a first crimping state, wherein said nest is located at a predetermined position wherein said nest is aligned with said first die, d) said locator having a second crimping state differing from said first crimping state, wherein in the second crimping state ea) said nest of said locator or eb) a second nest of said locator is located at a predetermined position wherein said nest or said second nest is aligned with said second die, f) wherein said locator is pivotable from said first crimping state to said second crimping state and vice versa, g) wherein said locator comprising a revolver with a plurality of nests, and h) wherein in said first crimping state of said revolver said first nest is aligned with said first die and in said second crimping state of said revolver said second nest is aligned with said second die.

* * * * *